US005472392A

United States Patent [19]

Haan et al.

[11] Patent Number: 5,472,392

[45] Date of Patent: Dec. 5, 1995

[54] CENTRIFUGAL RESISTANCE DEVICE FOR STATIONARY BICYCLE TRAINER

[76] Inventors: Kenneth Haan, 1232 Seminole Dr., Fort Lauderdale, Fla. 33304; Cal M. Phillips, 1800 NE. 179 St., Miami, Fla. 33162

[21] Appl. No.: 275,606

[22] Filed: Jul. 15, 1994

Related U.S. Application Data

[63] Continuation of Ser. No. 118,397, Sep. 8, 1993, Pat. No. 5,397,285.

[51] Int. Cl.[6] ..... A63B 23/06; A63B 21/22; A63B 69/16

[52] U.S. Cl. ..... 482/61; 482/63; 482/110; 188/78

[58] Field of Search ..... 482/57, 60, 61, 482/63, 110, 114, 119, 54; 434/25 R; 188/184, 185, 78; 192/105 BA, 106 R

[56] References Cited

U.S. PATENT DOCUMENTS

| | | | |
|---|---|---|---|
| 2,534,133 | 12/1950 | Kirkpatrick | 192/105 BA |
| 2,930,453 | 3/1960 | McNamara | 188/78 |
| 4,186,320 | 1/1980 | Hillman | 310/93 |
| 4,363,480 | 12/1982 | Fisher et al. | 482/54 |
| 4,441,705 | 4/1984 | Brown . | |
| 4,483,532 | 11/1984 | Sparks | 482/119 |
| 4,659,074 | 4/1987 | Taitel et al. | 482/54 |
| 5,163,888 | 11/1992 | Stearns | 482/110 |
| 5,244,446 | 9/1993 | Engel et al. | 482/119 |

*Primary Examiner*—Stephen R. Crow
*Attorney, Agent, or Firm*—Sixbey, Friedman, Leedom & Ferguson

[57] ABSTRACT

A centrifugal resistance device for stationary exercise apparatus that is operatively associated with a rotatable shaft; the centrifugal resistance device comprises a slotted ring, braking material and a fixed cover means; the slots of the slotted ring house friction material that is free to move radially and act frictionally against the fixed cover means positioned about the slotted ring, the fixed cover means is fashioned by those skilled in the art as to act also as a heat dissipating means; tension is varied by increasing or decreasing the RPMs of the rotatable axle.

10 Claims, 4 Drawing Sheets

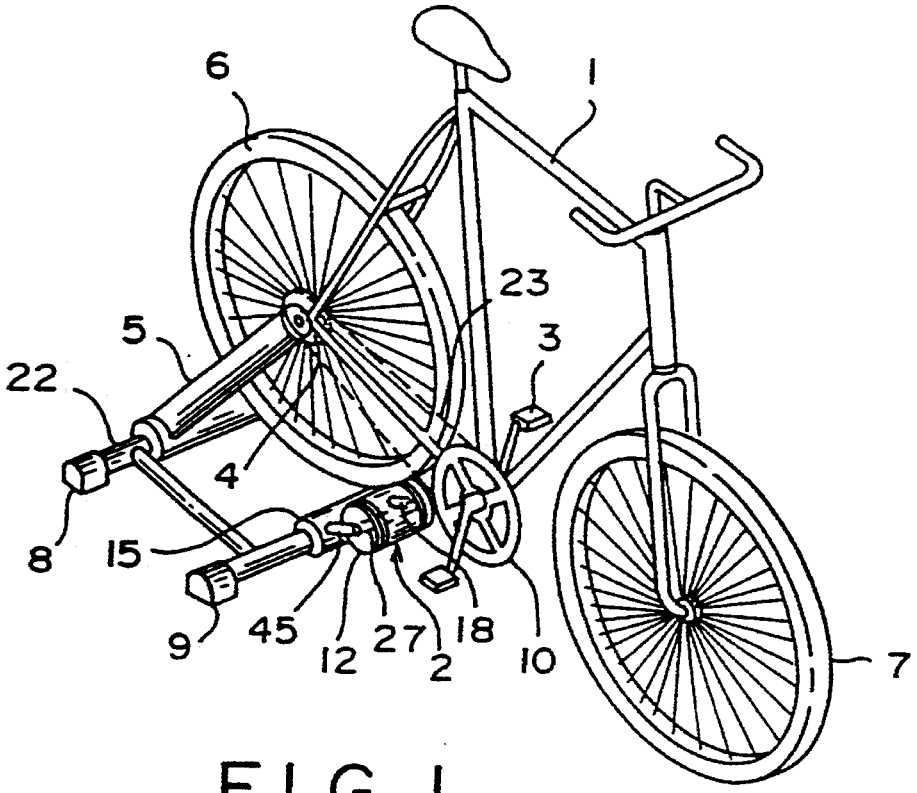
FIG. 1
FIG. 2
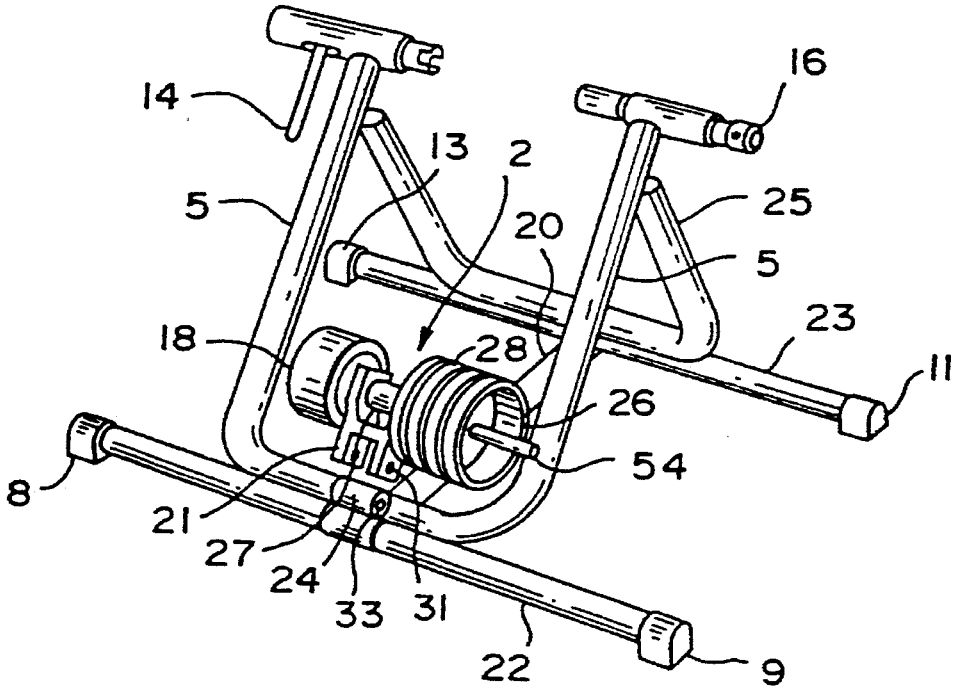

CENTRIFUGAL RESISTANCE DEVICE FOR STATIONARY BICYCLE TRAINER

This is a continuation application of Ser. No. 08/118,397, filed Sep. 8, 1993, now U.S. Pat. No. 5,397,285.

BACKGROUND OF THE INVENTION

1) Technical Field

This invention relates to resistance devices that are used to tension stationary exercise apparatus. In particular, the present invention relates to an improved and simplified centrifugal tensioning devices for stationary exercise apparatus that have a driven axle; even more specifically to bicycle trainers.

2) Background Information

The prior art on tensioning devices for bicycle trainers show various means of using disc brakes, friction plate brakes, magnetic resistance, and large and small fans for simulating wind load.

In particular the "state of the art" tensioning device for bicycle trainers is magnetic resistance and or fan resistance. Fan resistance is recognized as the best means of simulating wind load while riding. It is exponential in nature in that the faster one pedals, the more turbulence the fan causes exponentially. This was confirmed by the science editor for "Bicycling Magazine" Chester R. Kyle, PH.D. (P.76 December 1990 Issue of "Bicycling"). The drawback to fan resistance is noise. At 25 miles per hour a fan or wind trainer can generate over 80 decibels, a problem if you want to listen to music or watch TV or live in a thin walled apartment.

Magnetic resistance is quieter, producing about 60 decibels at 25 mph. However, MAGS are less realistic than fans because their resistance increases in direct proportion to speed, rather than exponentially. (P.70 December 1990 issue of BICYCLING magazine). Therefore, magnetic resistance does not simulate actual bicycle riding conditions. Another drawback to magnetic resistance is the high number of moving parts needed to manufacture one unit. This high number of moving parts makes magnetic resistance expensive to manufacture and undependable because of breakdown. The more moving parts the more potential for wear and breakdown. After about two years of use they tend to get noisy and need to be rebuilt.

The challenge was to design and build a resistance unit that provided the same exponential resistance as the fan, but, without the noise. The challenge was also to design a resistance unit that had few moving parts and was therefore inexpensive to manufacture and also one that provided variable resistance according to the level of the user and one that was also adaptable to any type of stationary exercise unit and also dependable.

A prototype was built of the subject invention and attached to the roller of a rear mount bicycle trainer for demonstration and testing purposes. The present invention made very little noise and the tension was directly related to the rate of speed of the driven axle; as the rate of speed of the driven axle increased, the tension increased exponentially, like the fan. It was found that the amount of tension could be varied by shifting the gears of the bicycle which either increased or decreased the speed of the rotatable shaft which in turn affected the centrifugal force acting on the radially moveable braking material. Increased speed caused the centrifugal force to increase which increased the friction of the braking material acting against the fixed cover. Clutch plate cork from the auto industry was found to be ideal braking material showing little wear and was inexpensive and easily replaceable. This high density cork also made no noise.

For stationary exercise equipment where gearing is not present, the means to vary the centrifugal resistance can be added. This can be accomplished by any known means by those skilled in the art; additional axially moveable braking material can be released from more slots, weight of the braking material can be varied and means to increase or decrease the rotational speed of the driven axle can be accomplished by adding different sized pulleys, effectively simulating the different rotary transmission means of a bicycle. Adding weight to the braking material increases the resistance. These and other ways of changing the resistance of the centrifugal tensioning device can be added by any known means by those skilled in the art. The more feed back the better, so the state of the art exercise machines utilize electronic sensors to detect heart rate, pulse, time, speed, cadence and computers to save previous work-outs etc. The centrifugal tensioning device can be adapted to work with and be controlled by these types of electronic feed-back devices by those skilled in the art.

Studies have shown that an RPM of between 60–80 RPM with a power output of 300 watts or roughly 24 miles per hour to be optimal. Heart rate, VO2 blood lactate levels, rate of perceived exertion and gross efficiency all seem to be at their optimal levels at 80 RPMs. Studies have also shown that as power output goes up so should the cadence. For instance, for track racing and sprint distance racing, an RPM of 110 appears to be optimal.

The challenge was to find the right combination of number and size of slots to house the correct weight and size of the braking material to provide ample variations in tension to the conventional bicycle trainer. Various sizes of rings, slots and braking material were experimented with to find the right combination of size, number and weight of material to provide enough tension based upon power output and RPMs to satisfy the work-out demands of both the casual rider and the professional racer.

There are five variables to work with in combination with a driven shaft; the size of the slotted ring, the number of slots, the kind of-braking material, the weight of the braking material and the speed of the driven rotatable shaft. It was found that a 2½" outside diameter ring ½" wide with four slots sized to house ¼" by ½" cork braking material when attached to a 1.3" rotating axle was ideal for a bicycle trainer with a multi-speed 26"–27" bicycle attached to it. Simple ½ inch deep drill holes positioned every 90 degrees around the ring were found to work effectively to house the braking material in the cavity formed by a simple drill bit.

For those skilled in the art, there are many size combinations that would work depending on the amount of tension desired on a particular exercise apparatus. A sixth variable comes into play on exercise devices that require a pulley system for hook up, such as rollers as illustrated in FIG. (5). The size of the pulley ring directly effects the speed of the slotted ring.

A by-product of friction is heat. It was found that during use, the friction cover got quite hot. To dissipate the heat, the cover can be manufactured in such a way by those skilled in the art to perform both as a friction cover and a heat dissipating means. This is accomplished by having radial grooves on the outer surface of the cover to help dissipate the heat and having a smooth inner surface to act as a friction surface. The high density cork was found to be an excellent non heat conductive material. It was found that while the friction cover got hot, the slotted ring which spins within the cover with ample clearance never got hot and the high density cork braking material did not transfer the heat. Teflon rod also worked and worked well against steel, noiselessly, while the cork worked well with the aluminum. Further research into graphite glass and Kevlar composites used in the heavy equipment braking industry proved to resist wear better and the higher coefficient of friction added more resistance. A suitable braking material has a high coefficient of friction and is wear resistant at 10–15,000 RPM's and withstands high heat.

OBJECTS AND ADVANTAGES

Accordingly, several objects and advantages of the invention are to provide a variable resistance device that has very few moving parts and is easily and inexpensively mass produced. A further object of this invention is to provide a dependable resistance device that can easily be adapted to work with any stationary exercise device.

Yet another object of this invention is to provide a resistance device that is quiet. The major disadvantage to fan tension is loud noise at high rpms.

Another advantage of this resistance device is that when it is adapted to fit the roller of a bicycle trainer, the gearing of the bicycle provides the variable resistance. By controlling the speed of the bicycle wheel with the existing gearing on the bike, the amount of centrifugal force acting on the radially flying braking material is also controlled. Thus, to vary the resistance, you simply shift the existing gears of the bike, just like on the road. By finding the right combination of size of slotted ring, size of slots and braking material, the multiple gearing of today's standard bicycle was advantageously utilized to provide the varied resistance. This was found to be extremely advantageous in that it kept the manufacturing cost down and provided varied resistance that was already accessible while on the bike and in fact provided by the bike. Most magnetic resistance units require the rider to get off the bike to switch the tension setting. Resistance devices where you can switch to a desired setting while on the bike are again more expensive because of the more parts required and the unit also becomes cumbersome and therefore less portable. More and more professional racers bring their trainer to big races for warm-up purposes, thus portability becomes an advantage.

Yet another object of this invention is to provide a variable resistance unit that will easily adapt to any bicycle trainer and replace older resistance units such as fans and magnetic units by simply sliding the old unit off the axle and sliding on the new centrifugal brake unit and fixing the friction cover to the frame with suitable fasteners.

Yet another object of this invention is to provide a simple resistance unit that can easily be adapted to any type of stationary exercise apparatus such as rowing machines and stationary bikes and stair steppers.

Yet another object of this invention is to provide a centrifugal brake unit whereby the friction cover acts also as a means of heat dissipation to effectively keep the unit to a lower heat level.

DRAWING FIGURES

FIG. 1 shows a bicycle on a stationary trainer with a centrifugal resistance device attached to a rotatable shaft and the rotatable shaft is located toward the front of the rear wheel.

FIG. 2 shows another type of bicycle trainer where a rotatable shaft is located toward the rear of the rear wheel and a centrifugal resistance device is attached to an internal rotatable shaft.

DETAILED DESCRIPTION

Figure 3:
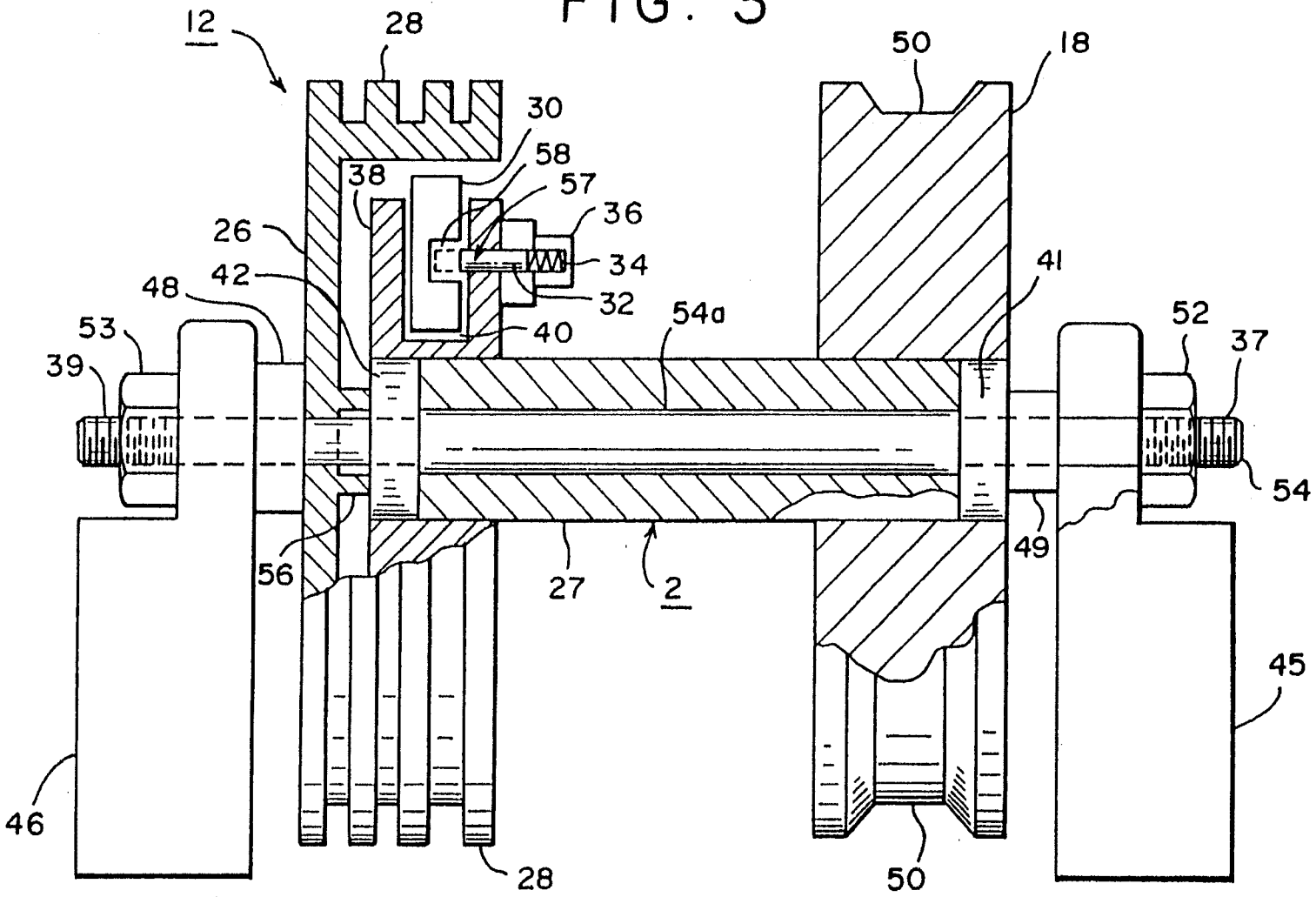
FIG. 3 is a sectional view of a trainer roller assembly with a centrifugal resistance device and the flywheel mounted to a rotatable shaft.

FIG. 1 illustrates a rear mount bicycle trainer 22 with a conventional bicycle 1 mounted on it for stationary exercise. Pedals 13 transmit power to a rear wheel 6, via an endless belt 23 connecting front sprocket 10 to rear wheel 6. Rear wheel 6 is in frictional engagement with roller assembly 2. Rotatable shaft member 27 is rotatably supported by conventional bearing means located in the hub portions of shaft 27 and supported by legs 18 which are fixedly attached to mounting bracket 15. Flywheel 16 and centrifugal resistance device 12 are fixedly attached to shaft 27. Roller assembly 2 is located to the front of the rear wheel of the bicycle in FIG. 1.

FIG. 2 illustrates another type of rear mount bicycle trainer where a roller assembly 2 is located to the rear of the rear wheel when the bicycle is mounted on the frame 22. Housings for quick release 14 and opposing threaded axle grab 16 are fixedly attached to upright support 5. Upright support 5 is fixedly attached to horizontal frame 22 to which rubber feet 8, 9, are attached. Strap 20 spaces horizontal frame members 22 and 23. Upright support 25 is pivotally attached to upright support 5 by suitable fasteners not shown. Horizontal frame member 23 has rubber feet 11 and 13 attached to either end and upright support 25 is fixedly attached to horizontal frame member 23. Flywheel 18 is fixedly attached to rotatable shaft 54 which is rotatably supported by conventional bearing means, said shaft 54 passes through mounting bracket 21, two bearings not shown, through roller 27 and through opposing side of mounting bracket 21 and through centrifugal resistance device 12. Friction cover 26 has heat sink groves 28 and said friction cover 26 is fixedly attached to mounting bracket 21. A suitable fastener not shown connects roller assembly 2 to horizontal frame member 22 through co-operating holes 31 and 32. FIG. 2 illustrates how easily a centrifugal resistance device slides onto shaft 54 and replaces fans and magnetic resistance devices normally located here opposite flywheel 18.

Figure 5:
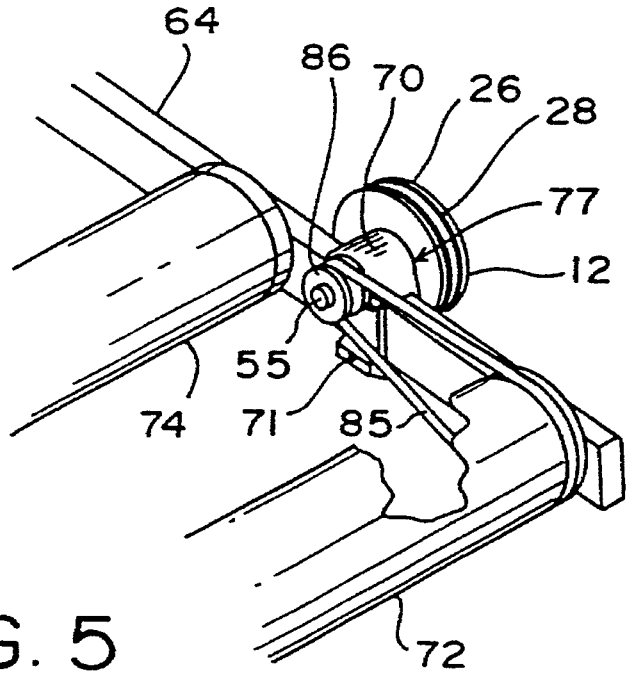
FIG. 5 shows a close up view of a centrifugal resistance kit attached to a support frame of a set of rollers utilizing a pulley and an endless belt for a rotary transmission means.

FIG. 3 is a cross-sectional side view of a roller assembly 2 and centrifugal resistance device 12. Roller assembly 2 consists of a rotatable shaft 27 preferably made of steel or aluminum. At either end of said shaft 27, bearings 41 and 42 are mounted by gluing or press fitting them into each end of said roller. A flywheel 18 is fixedly attached to one end of said shaft 27. Groove 50 of flywheel 18 is for use with an endless belt as shown in FIG. 5. Said centrifugal resistance device 12 is located at the opposite end of said shaft 27.

Centrifugal brake assembly 29 consists of a slotted ring 38 and friction cover 26. Slotted ring 38 partially houses braking material 30 which are free to react to centrifugal forces and free to move radially and to frictionally engage friction cover 26 during rotation of said shaft 27. Friction material 30 is preferably a high density cork material or teflon material which comes in extruded rod form and has an operating temperature of 550 degrees. Slotted ring 38 is fixedly attached to said rotatable shaft 27. Friction cover 26 has a spacer 56 machined onto the inside of the friction cover which goes up against the bearing race and spaces it away from said slotted ring. Friction cover 26 which resembles a shallow cup has a locating hole cut into and thru the bottom which allows it to be slid over internal axle 54 and located about slotted ring 38 so it never comes in contact with said slotted ring during rotation or any other time. A 0.050 clearance was found to be ideal. A raised ring 56 is machined into the inside of the friction cover and around the locating hole and sits against the inner race of the bearing.

An internal axle 54 which has external threads 37 and 39 is slid through said centrifugal resistance device, through rotatable shaft and bearings and mounted to support legs 45 and 46 by means of nuts 52 and 53 threaded onto external threads of the internal axle 54. Internal axle 54 also spaces the two bearings by having a larger diameter in the area between the two bearings.

Spacer 48 is located between the support leg 46 and the friction cover 26. Spacer 48 is preferably made of a non heat-conducting material such as high density cork so none of the heat is transferred to the frame. The friction cover 26 has radial heat sink grooves 28 located on the outer surface to help to dissipate the heat. The groves are preferably ½ inch deep. The cover can be fashioned in any manner by those skilled in the art to function both as a heat sink and a friction cover and can be made of any suitable material for this purpose by those skilled in the art. Spacer 49 is located between the bearing race and the support leg 45. To effect release of more or less friction material an optional manual operation means is shown.

Push button, two position plunger 32 is fixedly attached to the outside of slotted ring 38. Spring 34 loads plunger 32 by pushing button 36. Co-operating hole 58 in friction material 30 and co-operating hole 57 in slotted ring 38 allow two position plunger 32 to release or not release more axial moveable friction material. This just demonstrates one way more that braking material can be released if even more tension is desired. There are obviously many ways to accomplish the release of more braking material by those skilled in the art. The release of more braking material can be accomplished by those skilled in the art and can be released or not released at timed intervals for the purpose of computer simulated rides of different terrain such as flat sprints and hill climbs. The release can be controlled manually or electronically by those skilled in the art. Further means of manually affecting centrifugal resistance can be accomplished by those skilled in prior fishing real art by using springs and cams and combinations thereof.

Figure 4:
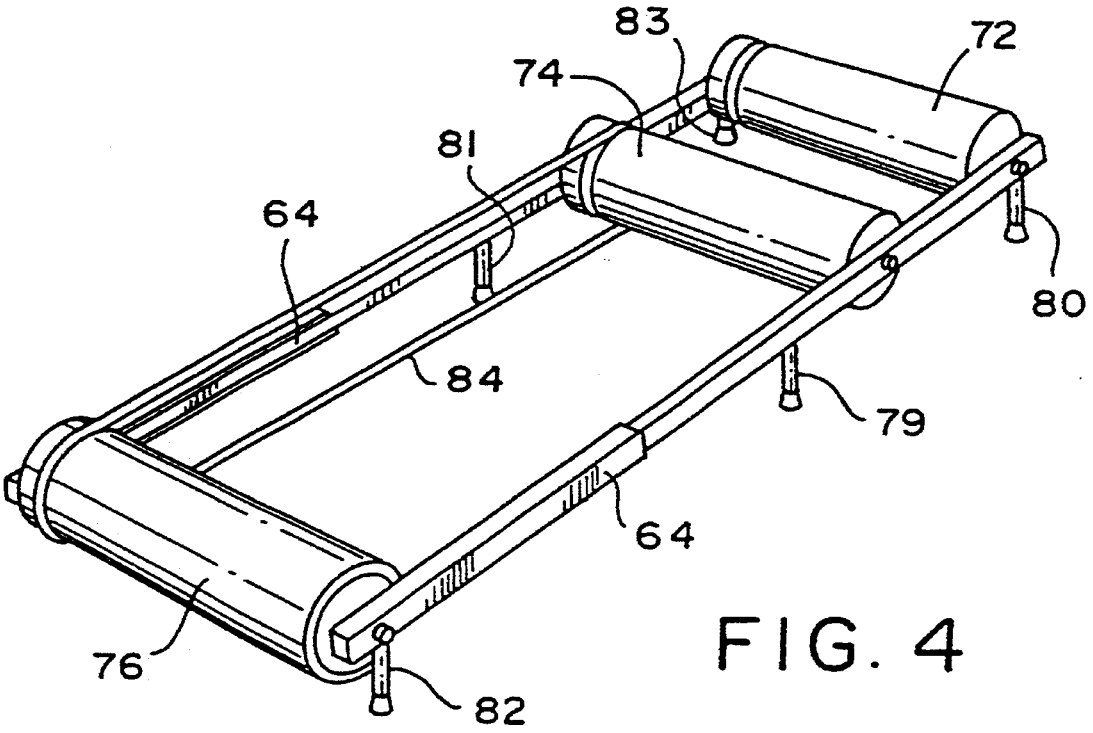
FIG. 4 shows a conventional set of rollers for stationary bicycle training.

FIG. 4 shows a conventional set of rollers for a bicycle for stationary training. Rollers 72, 74 and 76 are attached to frame 64. Legs 79, 80, 81, 82 83 are fixedly attached to a support frame 64. An endless belt 84 connects rollers 74 and 76.

FIG. 5 shows a close up view of a centrifugal resistance kit 77 attached to a conventional set of rollers shown in FIG. 4. Centrifugal resistance kit 77 consists of a mounting bracket 70 which is attached to a roller frame 64 by a suitable fastener 71. Rotatable shaft 54 extends through pulley 86, two bearings 41 and 42 housed by mounting bracket 70 shown in more detail in FIG. 6 and centrifugal resistance device 12 also shown in more detail in FIG. 6. An endless belt 85 connects pulley 86 to roller 72. Friction cover 26 with heat sink grooves 28 is fixedly attached to mounting bracket 70. Said friction cover and said mounting bracket can be molded into a one piece unit. Centrifugal resistance device 12 consists of a slotted ring 38, shown in more detail in FIGS. 3 and 6, that partially houses radially moveable fiction material 30, and a friction cover 26.

Figure 6:
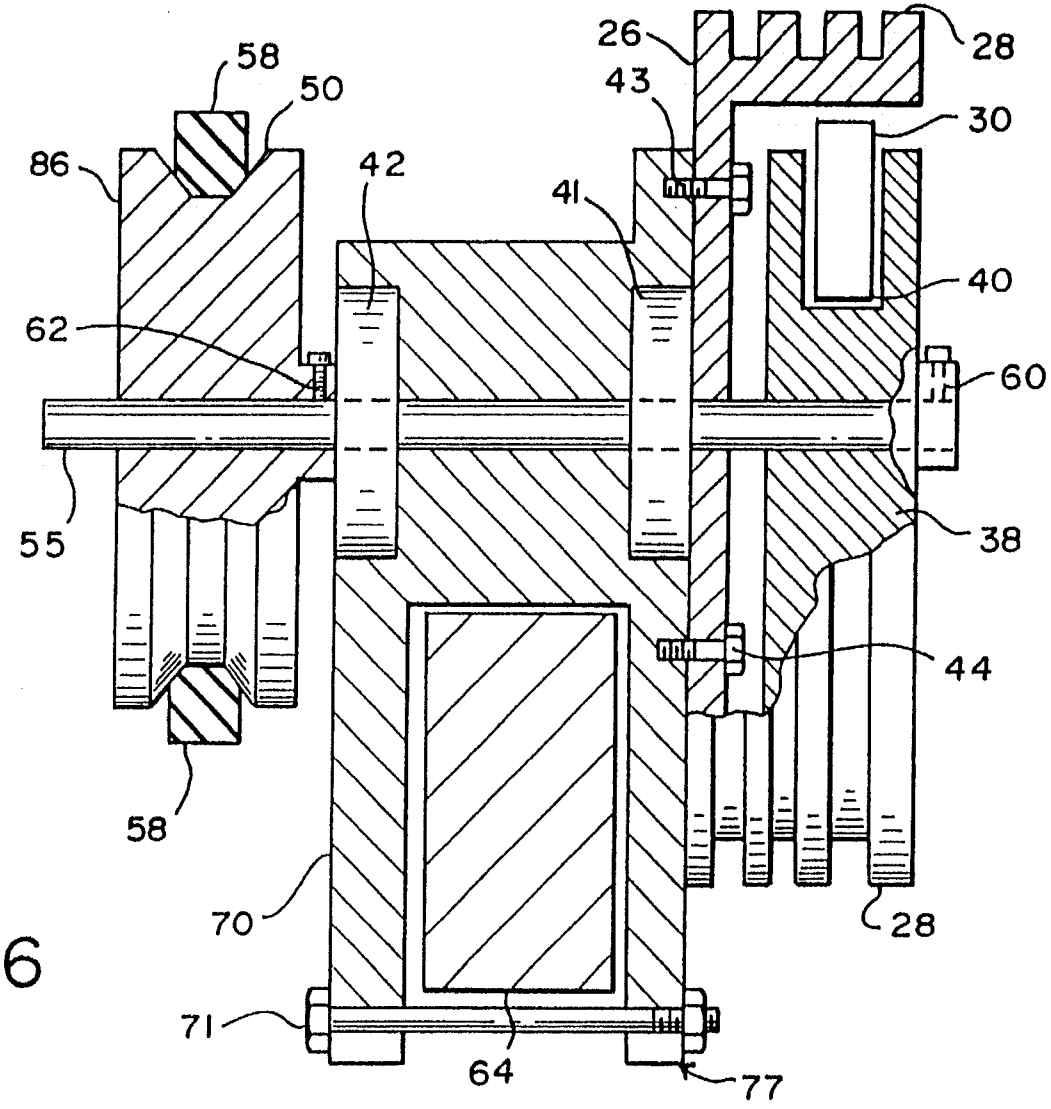
FIG. 6 is a more detailed cross-sectional view of a centrifugal resistance kit attached to a stationary exercise frame utilizing a pulley and an endless belt for a rotary transmission means and illustrating the attachment of a slotted ring to an internal rotatable axle.

FIG. 6 shows a cross-sectional view of centrifugal resistance kit 77 attached to a support frame 64 for a set of rollers shown in FIG. 4. Fastener 71 attaches mounting bracket 70 to said support frame 64. Pulley 86 is fixedly attached to rotatable shaft 55 by set screw 62. Endless belt 58 frictionally engages pulley grooves 50 and roller 72 shown in FIG. 5. Bearings 41 and 42 are housed by mounting bracket 70 and are fixedly attached to rotatable shaft 55. Friction cover 26 with radial heat sink grooves 28 is fixedly attached to mounting bracket 70 by suitable fasteners 43 and 44. Slotted ring 38 is also fixedly attached to rotatable shaft 55 by set screw 60. Slotted ring 38 has a plurality of slots 40 which house axially moveable braking material 30.

In operation, an exercise person pedals a bicycle that is supported by a frame in a stationary position. The bicycle tire of a conventional bicycle is in frictional engagement with a rotatable shaft of a rear mount trainer or set of rollers. Either the rotatable shaft 55 of FIG. 6 or rotatable shaft 27 of FIG. 3 is operatively associated with the rotation of the bicycle tire, which in turn rotates a slotted ring 38. During rotation, centrifugal forces come into play and force braking material 30 to fly out radially and act frictionally against friction cover 26. This causes resistance and forces the exercise person to work harder. The faster the rotation the more tension and more friction. The speed of rotation on a bicycle can be manually affected by simply shifting the gears of the bike. This directly effects the RPMs of the slotted ring and the centrifugal forces acting on the friction material.

Friction causes heat and radial heat sink grooves 28 help dissipate the heat. The tension is quiet and simulates the widely accepted but noisy fan tension. The friction cover and slotted ring are easily and inexpensively manufactured. This invention can easily be adapted to fit any type of stationary exercise unit by adapting the mounting bracket to fit any frame of a stationary exercise apparatus that utilizes a rotatable shaft. A pulley or plurality of pulleys in conjunction with rotary transmission means, transfers the rotary output to the centrifugal resistance kit or centrifugal resistance device and causes quiet exercise resistance. The centrifugal resistance device itself, not the kit, easily slides onto rotatable shafts of existing rear mount trainers and replaces the noisy fan unit. Not only is there a market for new bicycle trainers with a centrifugal resistance device as the primary resistance but there is also a market for trainers already sold to replace old fans, magnetic resistance and other resistance devices.

As this invention may be embodied in various forms to fit various types of stationary exercise apparatus without departing from the spirit or essential characteristics thereof, the present embodiment is therefore illustrative and not restrictive, and since the scope of the invention is defined by the appended claims, all changes that fall within the metes and bounds of the claims or that form their functional as well as their conjointly cooperative equivalents are therefore intended to be embraced by those claims.

What I claim is:

1. A centrifugal tensioning device for a stationary exercise apparatus, comprising:

a support stand, rotatably mounted on said stand about an axis;

a fixed cover means having a portion surrounding and radially spaced apart from said rotatable member with respect to said axis;

means for transferring exercise generated, rotary power to said rotatable member, and at least one braking means movably mounted on said member to move radially with respect to said axis for generating a braking force by frictionally engaging said surrounding and radially spaced apart portion of said cover means.

2. The centrifugal tensioning device of claim 1, wherein said braking means is freely moveable with respect to said rotatable member, and urged in a radial direction toward said cover means position solely as a result of centrifugal force applied thereto when said member is rotated by said power transferring means, and wherein the amount of frictional engagement between said braking means and said fixed cover means is dependent upon said centrifugal force.

3. The centrifugal tensioning device of claim 1, wherein said member is an annular member rotatably mounted with respect to a frame.

4. The centrifugal tensioning device of claim 1, wherein said braking means is slidably movable within a radially oriented opening in said rotatable member.

5. The centrifugal tensioning device of claim 1, wherein said braking means is free floating within said opening in said member, and wherein the only radially oriented force applied to said braking means is said centrifugal force.

6. The centrifugal tensioning device of claim 1, wherein said member is a ring-shaped member, and wherein said braking means is partially received within openings in said member that are radially oriented with respect to said axis of rotation.

7. The centrifugal tensioning device of claim 6, wherein said ring-shaped member includes four openings around its outer periphery uniformly spaced 90° from each other, and wherein a braking means is partially received within each of said openings.

8. The centrifugal tensioning device of claim 1, wherein said fixed cover means includes a heat dissipating means.

9. The centrifugal tensioning device of claim 1, further comprising a flywheel member operatively associated with said rotatable member for providing smoother rotary movement to said rotatable member.

10. A centrifugal tensioning device for an exercise apparatus, comprising:

a support stand rotatably mounted on said stand for rotating in response to exercise, the rotational speed of said member being dependent upon a rate of exercise;

a fixed cover means adjacent to an outer edge of said rotatable member, and at least one braking means slidably moveable within a radially oriented opening in said member for moving radially with respect to the axis of rotation of said member and generating a braking force by frictionally engaging said cover means.

* * * * *